United States Patent [19]

Blaseck

[11] Patent Number: 4,952,165

[45] Date of Patent: Aug. 28, 1990

[54] ASSEMBLY FOR REMOTE HANDLING OF AN ELECTRICAL PLUG CONNECTOR

[75] Inventor: Klaus Blaseck, Ehlershausen, Fed. Rep. of Germany

[73] Assignee: Deutsche Gesellschaft Fur Wiederaufarbeitung Von Kernbrennstoffen mbH, Hanover, Fed. Rep. of Germany

[21] Appl. No.: 346,590

[22] Filed: May 2, 1989

[30] Foreign Application Priority Data

May 3, 1988 [DE] Fed. Rep. of Germany ..... 3815033

[51] Int. Cl.[5] ..... H01R 13/60

[52] U.S. Cl. ..... 439/247; 29/762; 439/348; 439/528; 901/41

[58] Field of Search ..... 439/476, 480, 528, 247, 439/248, 348; 29/729, 760, 762, 764, 426.1–426.6; 285/920; 901/29, 30, 31, 38, 41, 50

[56] References Cited

U.S. PATENT DOCUMENTS 4,661,892 4/1987 Reed, Jr. ..... 362/226

FOREIGN PATENT DOCUMENTS 2628865 9/1980 Fed. Rep. of Germany .
2559774 8/1983 Fed. Rep. of Germany .

*Primary Examiner*—Neil Abrams

*Attorney, Agent, or Firm*—Cushman, Darby & Cushman

[57] ABSTRACT

An assembly for remotely handling an electrical plug connector, including a bottom block, including a crane hook attachable to a crane, a first plug member fixed to the bottom block and electrically connectable to a power supply, a second plug member electrically connected to a load, a retaining device retaining the second plug member such that electrical coupling and decoupling between the first and the second plug member can be effected by mere movement of the bottom block in the horizontal and the vertical plane. When the first and second plug members are vertically aligned, coupling and decoupling can be effected by mere lowering and raising of the bottom block. The retaining device has parallel prongs with recessed surface areas to hold the second plug member, alternatively, in a locking position and a withdrawing position. The second plug member has a spherical thickened contour portion acting as a pivot enabling it to swing into alignment with the first plug member. The second plug member can be moved between the locking and the withdrawing positions by a horizontal shifting motion of the bottom block. The second plug member can be removed from the retaining device when in the withdrawing position but not when in the locking position. When the second plug member is being removed, the crane hook is free to grasp an eye of an operational equipment.

9 Claims, 4 Drawing Sheets

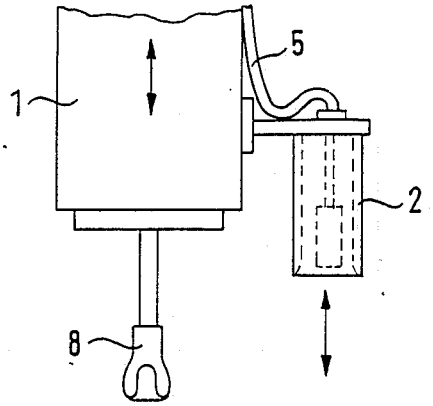
FIG. 1
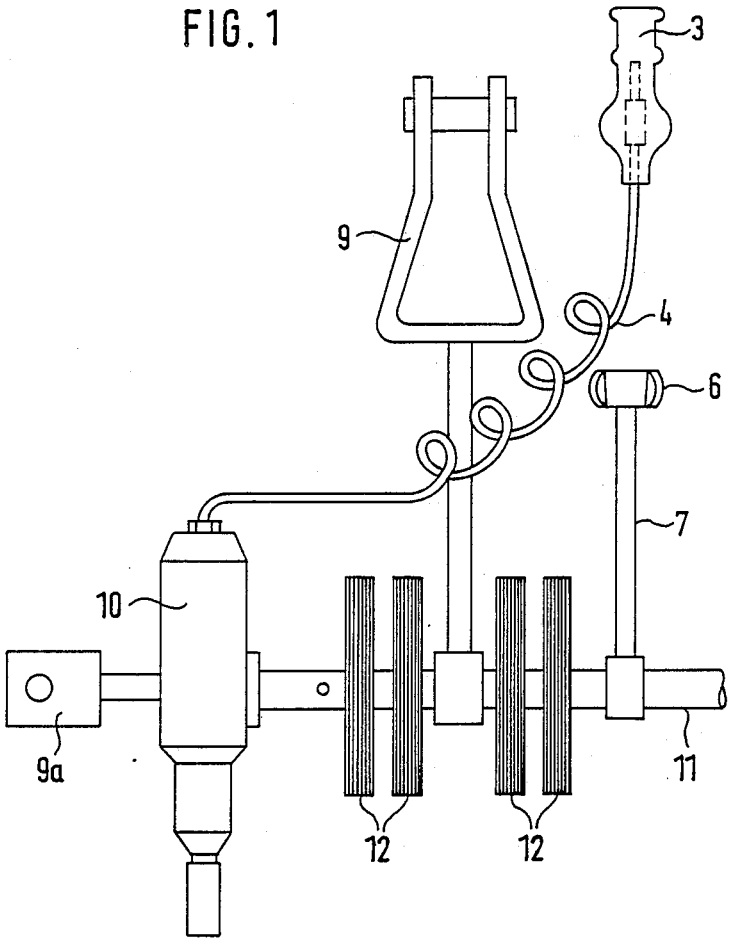

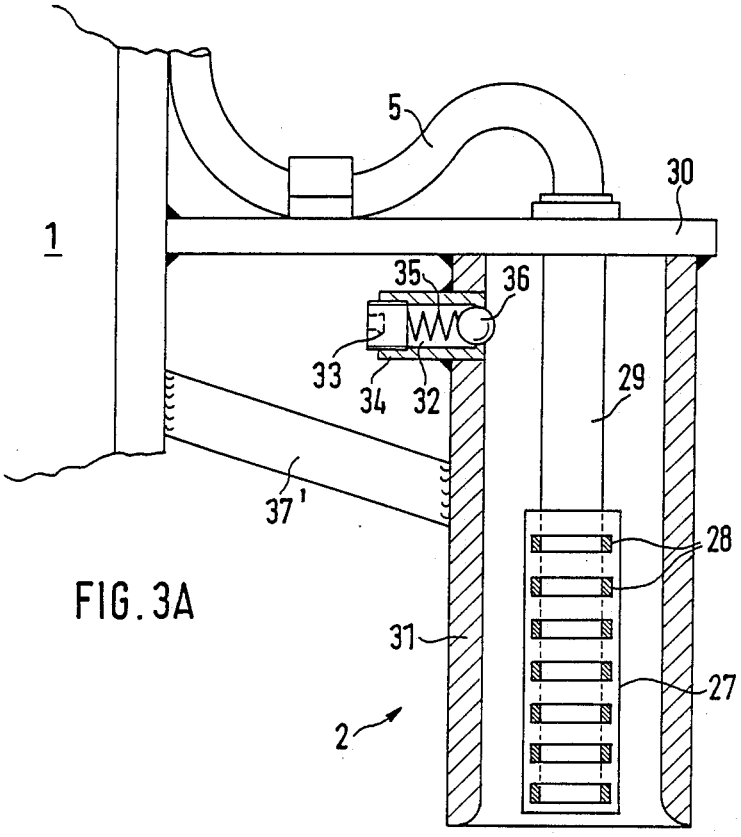
FIG. 3A
FIG. 3B
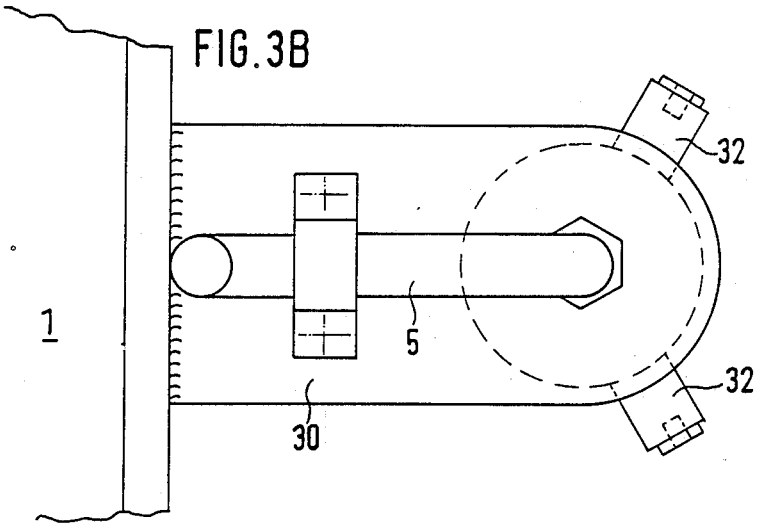

ASSEMBLY FOR REMOTE HANDLING OF AN ELECTRICAL PLUG CONNECTOR

FIELD OF THE INVENTION

The invention relates to an assembly for coupling an electrical plug connector by remote handling.

BACKGROUND OF THE INVENTION

Such an assembly is known from DE-PS 26 28 865 which provides for the use of gripping devices to accomplish the coupling. The gripping devices are adapted to be opened and closed by a drive motor and spindles including spindle nuts. The electrical connection in the known case is made by way of a multipole plug which comprises a plurality of plug and socket contacts. This known means is intended for use in nuclear plants to connect supply lines of a rail-bound vehicle.

An electrical plug connector which includes a single multipole plug member is known from DE-PS 25 59 774.

In many branches of industry electrical plug connections must be actuated without permitting any human to have direct access to them. This is true in particular of nuclear and chemical plants. Generally that requires additional handling means, such as electromechanical manipulators, active coupling systems and the like to carry out the coupling procedure, as shown also by DE-PS 26 28 865. The use of active coupling systems moreover makes it necessary to provide further auxiliary drive means (e.g. draw-in spindles) which in turn need their own power supply. As a result, a greater number of individual conductors are needed in the lead wires and the dimensions of the cable storage facility suffer accordingly. Moreover, the reliability of the whole system is affected by the additional drive means. The same is true of the manipulators whose reliability often is not as one would wish for.

In the remote operating technique of nuclear installations there is a remote manipulating system which employs a crane. The crane hook may be utilized to grasp a great variety of working tools, transport them to their job location, and hold them there in proper position during work. The crane hook further is suitable to take up pieces for exchange and convey them. This is an extremely sturdy system, it is easy to handle, and can be adapted to the most varied tasks. However, difficulties are being encountered with this system when it comes to making and breaking electrical connections between power supply means, control lines, etc. and operating equipment, such as electrical tools to be carried by the crane.

SUMMARY OF THE INVENTION

It is, therefore, an object of the instant invention to provide an electrical plug connection which functions in combination with a crane and is of highly robust nature. It is another object of the invention to provide an electrical plug connection of the kind in question which will require the smallest possible number of particular parts provided specifically for the coupling procedure of the electrical plug connection.

For achieving the foregoing objectives, an assembly for remote handling of an electrical plug connector includes (1) a hook-type bottom block attachable to a crane, (2) first plug member fixed to said bottom block and electrically connected to a power supply network;

(3) second plug member electrically connected by a cable to a load; and (4) means for retaining said second plug member in a position for coupling and decoupling with said first plug member by mere movement of the bottom block through operation of the crane. When the first and second plug members are vertically aligned, coupling and decoupling is achieved by only lowering and raising the bottom block. The retaining means also operates for retaining the second plug member, alternatively, in a first locking position and a second withdrawing position; the second plug member is movable between the locking and the withdrawing position by horizontal shifting of the bottom block. The second plug member may be removed from said retaining means when in the withdrawing position but not when in the locking position.

It is an essential advantage of this invention that the electrical plug connection is coupled and uncoupled by remote handling exclusively by moving the crane, while the hook of the crane or the load-carrying hook remains free to take up a load (operational equipment) which needs to be supplied with power. A particular manner of using a preferred embodiment of the present invention is described below:

Once the crane is aligned, the coupling or connecting of the electrical plug connector is effected purely by lowering movements of the hook-type bottom block of the crane. During this procedure the lower plug member which is associated with the current utilizing device or operational equipment is fixed in a retaining device. When made, the electrical plug connection may be removed from the retaining device by horizontal movements of the hooktype bottom block of the crane. The crane hook then is free to engage an eye of an electrical tool. The uncoupling is effected in inverted order. First, the electrical tool is laid down at a predetermined location, then the crane hook is unhooked from the eye. Thereupon the electrical plug connection is moved into the retaining device until it reaches a locking position in which the lower plug member is fixed in Z-direction (up and down movements). The plug members may be separated again by pure lifting motion of the hook-type bottom block of the crane. The reactive forces both for the pulling operation and for the plugging-in are applied by the retaining device for the lower plug member.

A certain problem in utilizing a crane with remotely handled means is caused by the fact that the control of the crane hook is rather inaccurate or lacks precision. This relative shortcoming is overcome by a feature of a preferred embodiment of the invention that canting is excluded even if the axes of the two plug members should be somewhat offset with respect to each other.

A summary of essential advantages of this invention is as follows:

- coupling and decoupling of the connection between two plug members can be achieved by remote handling merely by motion of the bottom block, while the hook of the crane or the load-carrying hook remains free to take up a load or operational equipment which needs to be supplied with power;
- no additional active auxiliary means are needed to actuate the plug-in connection;
- no additional performance is required to accomplish the coupling procedure;
- plug connectors may be used which are reliable and not sensitive;

when the plug connection is established the load hook can be engaged with carrying eyes at different locations so as to bring about the desired manipulating position of the operational equipment.

BRIEF DESCRIPTION OF THE DRAWING

The invention will be described further by way of example, with reference to the accompanying drawings, in which:

FIG. 1 is a diagrammatic side elevation of the means according to the invention;

FIGS. 3A and 3B show the other (upper) plug member which is secured to the hook-type bottom block of the crane, in longitudinal section and top plan view, respectively;

DESCRIPTION OF THE PREFERRED EMBODIMENT

Figure 2:
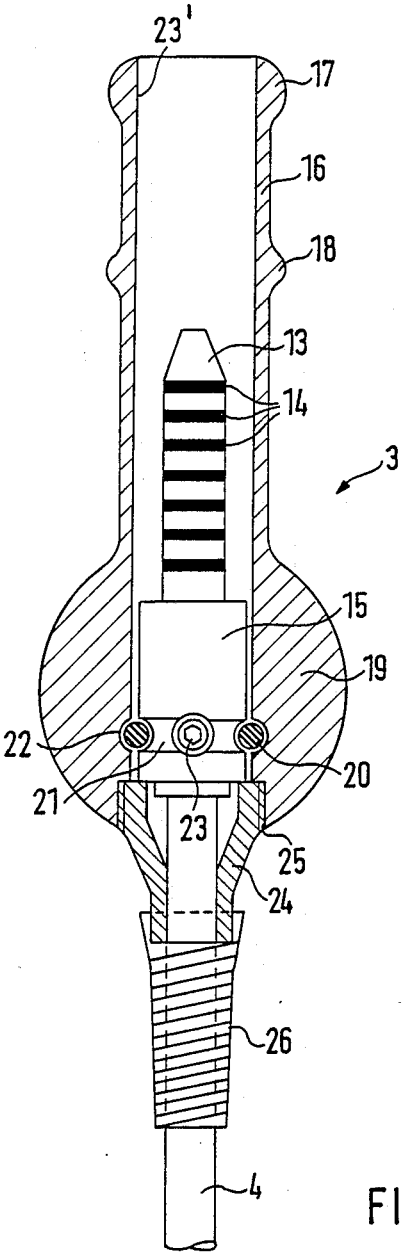
FIG. 2 is a longitudinal sectional elevation of the one plug member (the lower one)

Like reference numerals designate like parts throughout the drawings.

FIG. 1 shows a hook-type bottom block 1 of a crane which bottom block is connected by ropes or tackles (not shown) to the trolley of a crane. The hook-type bottom block can be moved up and down, as indicated by the arrow. It can also be displaced horizontally during the so-called trolley travel. An upper first plug member 2 of the electrical plug connection is fixed at one side of the hook-type bottom block 1 of the crane. A lower second plug member 3 is associated with the first plug member and is connected by a cable 4 to a load 10. This load 10 may be in the form of any operational equipment suitable for being actuated by remote handling, such as an impact screw driver. The first plug member 2 in turn is connected electrically to a central unit by a cable 5 which serves both for power supply and for the transmission of control commands.

Both plug members 2 and 3 are oriented vertically. In the case of the upper plug member 2 this is caused by the natural hanging position of the hook-type bottom block of the crane and the orientation of the upper plug member which is parallel to the same. With the lower plug member 3 this is effected by a retaining device 6 which makes sure, by its configuration and other measures, such as the location of the center of gravity of the lower plug member and the net weight of the cable 4, that the lower plug member 3 is oriented substantially vertically when it is held by the retaining device 6.

With the embodiment shown in FIG. 1, the retaining device 6 is mounted on an upright tube 7 which in turn is fastened to a beam 11. When set down, the beam 11 is directed horizontally. The current utilizing device or load 10 is fastened to the beam as well as an eye 9 and compensating weights 12. When the entire unit of the "operational equipment" is grasped by the eye 9, in the present case this means that the impact screw driver 10 is oriented vertically in downward direction. Further eyes may be provided by means of which the impact screw driver may be given a different orientation. In axial extension of the beam 11, for example, another eye 9*a* is provided at the impact screw driver 10. If this eye is grasped by the crane hook 8, the impact screw driver 10 will be oriented horizontally once the entire unit has been lifted. Further eyes may be arranged, as desired. The relative spacing between the eye 9 and the retaining device 6 should be selected such that the electrical plug connector may be coupled without the crane hook 8 and the eye 9 touching each other.

In another embodiment of the invention (not shown) the retaining device 6 and the load 10 are totally separated from each other, the retaining device 6 being stationary and, therefore, not moved along when the impact screw driver 10 is being transported.

In the embodiment shown, the first plug member 2 is designed as a socket and the second plug member 3 as a plug. Of course, the arrangement could be inverted just as well.

Plug member 3 will be explained in greater detail with reference to FIG. 2. This plug member comprises an essentially cylindrical, central, multipole plug contact 13 whose individual contacts 14 are formed as rings which are insulated with respect to one another in axial direction of the plug contact 13 and disposed offset. Each individual contact 14 is connected to a core of the cable 4. The plug contact 13 is fastened to a cylindrical basic body 15, the cable 4 being attached to the opposite side of the basic body 15. The plug member 3 comprises a centering sleeve 16 concentrically surrounding the plug contact 13 and extending in axial direction beyond the free end thereof. Between the inner wall of the centering sleeve 16 and the plug contact 13 a space is defined to take up a socket portion which will be explained below with reference to FIG. 3. A plurality of centering beads 17 and 18 are formed at the outer surface of the centering sleeve. They project radially from the outside of the centering sleeve like annular elevations.

At the end facing the cable 4, the centering sleeve merges into a spherical thickened portion 19. Together with the retaining device 6 which will be described further with reference to FIG. 4, this thickened portion 19 serves as a pivot bearing which permits the plug members to swing and thus become aligned. The basic body 15 is fixed in the range of the spherical thickened portion 19 by a plurality of rather small spheres 20 retained partly in a groove 21 formed in the basic body 15 and partly in a groove 22 formed in the central opening 23'. For assembly these spheres may be introduced through a bore 23 which extends in radial direction. Upon filling the bore may be closed by a screw. This kind of support by way of spheres 20 has various advantages. It can be realized quite easily and, while warranting firm seating, still permits some further slight swinging of the plug contact 13 and of the basic body 15 with respect to the centering sleeve 16, whereby dimensional tolerances between the male and female members can be compensated. To this end, furthermore, the outer diameter of the basic body 15 is smaller than the inner diameter of the central opening 23', which means that here clearance was provided on purpose.

The basic body 15 is secured in the spherical thickened portion 19 by a threaded sleeve 24 which is threaded into a threaded bore 25 presented at the lower end of the central opening 23' and which has its end face abut against the end face of the basic body 15 and against an edge of the threaded bore 25. In this manner accurate alignment in vertical direction is achieved prior to filling in the spheres 20. In addition to the threaded sleeve 24 a resilient guard socket 26 may be threaded into engagement with the end facing the cable 4 of the threaded sleeve 24.

FIGS. 3A and 3B illustrate socket member of the plug connection. The socket member is fixed at the hook-type bottom block 1 of the crane by a lateral cantilever-type arm 30. The socket member 2 includes a plug socket 27 comprising a plurality of annular individual contacts 28 analogous to the individual contacts 14 of the plug contact 13. A central bore formed in the plug socket 27 is adapted to the diameter of the plug contact 13 so that each individual contact 14 will just establish an electrical connection with the associated individual contact 28 when the plug contact has been introduced. The individual contacts 28 each are connected to a core of cable 5, these cores passing through a tube 29 which is holding the plug socket 27 and is fastened to the cantilever-type arm 30.

The length of the tube 29 just corresponds to the length by which the centering sleeve 16 projects beyond the plug socket 13. This means that when the plug connection is fully coupled, the free end of the centering sleeve 16 just abuts against the bottom surface of the cantilevertype arm 30.

The socket member, too, has its centering sleeve 31 which is welded to the cantilever-type arm 30 and extends coaxially with the plug socket 27 and the tube 29. The centering sleeves 31 and 16 cooperate such that the centering sleeve 16 of the plug member can be slid into the centering sleeve 31 with the centering beads 17 and 18 just engaging the inside wall of the centering sleeve 31.

Three locking means 32 which are offset angle-wise are provided in the area of the upper end of the centering sleeve 31. They become engaged behind the centering bead 17 by a spring-loaded ball, thus effecting the locking. The locking force may be selected by the spring bias, a screw 33 being provided for this purpose which can be threaded into a sleeve 34 housing the spring 35, thereby to press against the ball 36. The open end of the sleeve 34 is formed with a constriction to prevent the ball 36 from falling out.

Another support arm 37' may be provided between the hook-type bottom block 1 of the crane and the centering sleeve 31 to increase the stability.

The top plan view of FIG. 3B essentially illustrates the offset arrangement of the locking means 32.

Figure 4A:
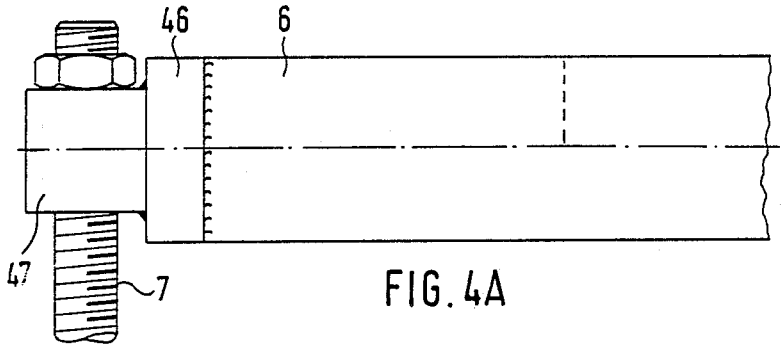
FIGS. 4A to 4C show the retaining device which receives the lower plug member, in side elevation, top plan view, and front elevation, respectively.
Figure 4B:
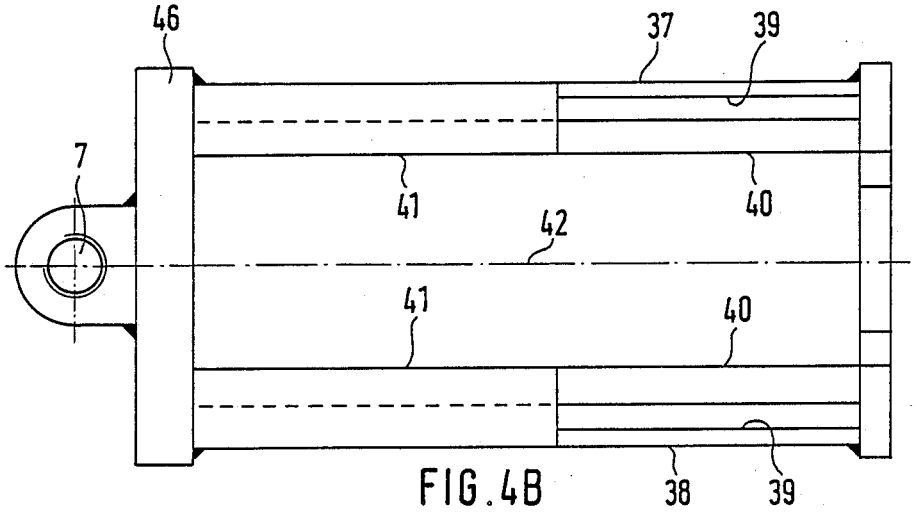
Figure 4C:
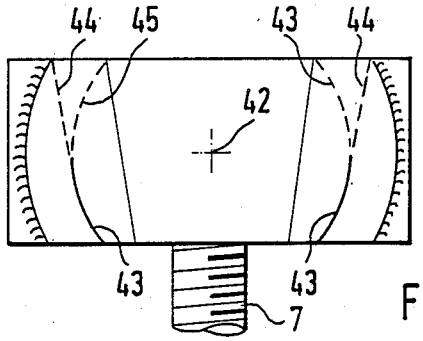

FIGS. 4A–4C illustrate the retaining device 6 for the lower plug member 3. This retention must fullfill the following tasks:

1. it must retain the plug member vertically aligned when the electrical plug connection is uncoupled;
2. it must take up the reactive forces (pull and push) for coupling and uncoupling;
3. it must permit the plug member to be removed from the retaining device solely by shifting of the crane hook.

To meet those demands, the retaining device 6 is fork-shaped, being furnished with two spaced apart, parallel prongs 37 and 38 each formed at the respective inner surface, i.e. the surfaces facing each other, with a recess of varying configuration in longitudinal direction of the prongs. In the area of one end of the prongs the recess is designed to be open upwardly so that the spherical thickened portion 19 can be introduced or removed from above. On the other hand, it is closed towards the bottom so that the spherical thickened portion 19 cannot fall through but instead only the cable can hang down unobstructedly. The top opening is marked in FIG. 4B by the edge exposed to view 39, whereas 40 marks a continuous lower edge exposed to view which edge prevents the spherical thickened portion from falling through downwardly in all areas. In other words, the spacing between the edges 40 of the two prongs 37 and 38 is smaller than the diameter of the spherical thickened portion 19.

In the area of the other end of the prongs 37 and 38 the recess is closed to the top and to the bottom. In this area (lines 41) thus the edge exposed to view 39 is drawn inwardly to be flush with the edge exposed to view 40. In this area the plug member cannot be withdrawn, either upwardly or downwardly, it can merely be shifted parallel to the longitudinal direction of the prongs.

FIG. 4C shows the contour of the recess even more clearly. Up to the level of the center line 42, the lower part of the recess 43 is adapted respectively to the shape of the sphere. In the front part, beginning at the center line 42, the recess is open to the top, as characterized by line 44. In the rear part, however, the recess is closed to the top, as illustrated by line 45.

The two "prongs" 37 and 38 are welded to a transverse beam 46 which in turn is held by a sleeve 47 on the upright tube 7.

In another embodiment of the invention (not shown) it is provided that the electrical plug connection at the same time is a means to carry a load. In this case the crane hook 8 and the eye 9 may be dispensed with. Instead of the crane hook 8 the plug member 2 then is mounted centrally at the hook-type bottom block 1 of the crane. Analogously, the plug member 3 then is mounted at the place of the eye. A kind of locking which will be suitable to carry the full load as well can be achieved by rotary movement between the two plug members 2 and 3 in combination with a bayonet-type fitting.

What is claimed is:

1. An assembly for remote handling of an electrical plug connector, comprising:

a hook-type bottom block attachable to a crane;

first plug member fixed to said bottom block and electrically connectable to a power supply;

second plug member electrically connected to a load;

means for retaining said second plug member in a position for coupling with and decoupling from said first plug member by mere movement of said bottom block through operation of said crane; whereby when said first and second plug members are vertically aligned coupling and decoupling can be achieved by only lowering and raising said bottom block;

said retaining means also selectively retaining said second plug member in either a locking position or a withdrawing position, said second plug member being movable between said locking and said withdrawing position by horizontal shifting of said bottom block; whereby said second plug member may be removed from said retaining means when in said withdrawing position but not when in said locking position.

2. The assembly as claimed in claim 1, wherein said retaining means permits swinging motion of the second plug member.

3. The assembly as claimed in claim 2, wherein the second plug member has a spherical thickened portion, and the retaining means includes two parallel prongs whose surfaces facing each other are formed with recesses including portions thereof which correspond to at least parts of the spherical shape of said spherical thickened portion.

4. The assembly as claimed in claim 3, wherein said recesses in one area along the length of said parallel prongs are upwardly open so that said spherical thickened portion can be removed from said retaining means in an upward direction.

5. The assembly as claimed in claim 4, wherein said first and second plug members each comprises a centering sleeve adapted to be slid into engagement with each other, one centering sleeve having centering beads formed to project radially outwardly and adapted to the inner diameter of the other centering sleeve.

6. The assembly as claimed in claim 5, further comprising means for supporting swinging motion of a plug contact of said second plug member in the interior of its associated centering sleeve.

7. The assembly as claimed in claim 6, further comprising spring loaded locking means for holding together the two plug members up to a predetermined pull.

8. The assembly as claimed in claim 7, wherein the retaining means is stationary.

9. The assembly as claimed in claim 8, wherein the retaining means is connected to the load.

* * * * *